US006957762B2

(12) United States Patent
Kroetsch et al.

(10) Patent No.: US 6,957,762 B2
(45) Date of Patent: Oct. 25, 2005

(54) VACUUM BRAZING METHOD FOR ALUMINUM-BASED MATERIAL

(75) Inventors: Karl Paul Kroetsch, Williamsville, NY (US); Ange D. Koeppen, Ransomville, NY (US); Charles K. Rottner, East Amherst, NY (US)

(73) Assignee: Delphi Technologies, Inc., Troy, MI (US)

( * ) Notice: Subject to any disclaimer, the term of this patent is extended or adjusted under 35 U.S.C. 154(b) by 313 days.

(21) Appl. No.: 10/361,248

(22) Filed: Feb. 10, 2003

(65) Prior Publication Data

US 2004/0155095 A1 Aug. 12, 2004

(51) Int. Cl.[7] ..... B23K 31/02
(52) U.S. Cl. ..... 228/221; 228/254; 228/262.51
(58) Field of Search ..... 228/221, 245, 228/246, 248.1, 254, 256, 262.5, 262.51

(56) References Cited

U.S. PATENT DOCUMENTS 4,574,878 A * 3/1986 Sugiyama et al. ..... 165/134.1
4,781,888 A * 11/1988 Hagiwara et al. ..... 420/531
4,838,341 A * 6/1989 Bye et al. ..... 164/463
4,929,511 A * 5/1990 Bye et al. ..... 428/606
5,158,621 A * 10/1992 Das et al. ..... 148/528
5,286,314 A * 2/1994 Das et al. ..... 148/528
5,332,455 A * 7/1994 Chang et al. ..... 148/440
6,152,354 A * 11/2000 Childree ..... 228/206
6,361,882 B1 * 3/2002 Shoji et al. ..... 428/654
2004/0155095 A1 * 8/2004 Kroetsch et al. ..... 228/246

FOREIGN PATENT DOCUMENTS

JP 51096749 A * 8/1976
JP 55038965 A * 3/1980
JP 355099597 A * 7/1980
JP 60205195 A * 10/1985
JP 404173934 A * 6/1992
JP 02000204427 A * 7/2000

* cited by examiner

*Primary Examiner*—Kiley S. Stoner
(74) *Attorney, Agent, or Firm*—Patrick M. Griffin

(57) ABSTRACT

A vacuum brazing method is disclosed for joining aluminum stock materials to each other. The typical cladding material utilized includes aluminum and a melting point lowering agent such as silicon. In addition, the cladding material typically includes magnesium to provide for enhanced wetting of the cladding material into the joint area. It has been found that adjusting the ratio of magnesium to calcium to a level of equal to or greater than 625 to 1 provides greatly enhanced brazed joint formation and reliability of the vacuum brazing method.

20 Claims, 2 Drawing Sheets

VACUUM BRAZING METHOD FOR ALUMINUM-BASED MATERIAL

TECHNICAL FIELD

The present invention is related to a vacuum brazing method, and more particularly, to a method and cladding material for vacuum brazing aluminum-based stock material.

BACKGROUND OF THE INVENTION

Aluminum and its alloys are widely used in the manufacture of many components. Often several aluminum components need to be joined to each other in a bonded manner. The aluminum components are frequently joined by utilizing a brazing process. Aluminum and aluminum alloy stock material find special utilization in the formation of components of heat exchangers such as condensers, evaporators, heater cores, coolers, and radiators. Typically, magnesium is added to the formulation of the aluminum stock material to provide the characteristics of increased strength and corrosion resistance. There are two common methods for braze joining pieces of aluminum. One method comprises controlled atmosphere brazing (CAB) wherein the brazing process is carried out in a brazing furnace employing an inert gas atmosphere of, for example, argon or nitrogen. In the CAB process a cladding material and a flux material, typically potassium fluoroaluminate, are applied to at least one of the stock pieces prior to the brazing process. The flux material breaks up the surface layer of aluminum oxide so a strong braze joint can develop. One limitation on use of the CAB process is that the maximal magnesium level in the stock material is generally limited to approximately 0.3% because of undesirable interactions between the magnesium in the stock material and the fluoride in the flux material. Therefore, it is more common to use a vacuum brazing process when the stock material contains higher levels of magnesium.

In a vacuum brazing process no flux material is employed just the cladding material is used. The vacuum brazing process can be difficult to control and requires a well-sealed furnace, careful control of pressure in the furnace, and very clean stock material.

For both the CAB and vacuum brazing processes at least one of the pieces to be joined must be clad with a thin layer of the cladding material, which actually forms the braze joint between the pieces. When joining aluminum based materials, this cladding layer typically includes aluminum as the primary component. Other materials are added to the cladding material to lower its melting point below that of the pieces to be joined. Thus, during the brazing process the cladding material is melted, flows between the pieces and then forms a solid joint when it is cooled. Typically, silicon is included in the cladding material in order to lower the melting point. In addition, the cladding material typically includes added magnesium, which acts similarly to flux in the CAB process. The magnesium diffuses during the brazing process thereby breaking up the external aluminum oxide layer, acting as a surface wetting agent. The diffusion or out-gassing of magnesium permits the cladding material to flow between the aluminum pieces and results in braze joint formation. Thus, magnesium is typically added to the cladding material for this function. The cladding material often comprises other components including calcium. Calcium is not intentionally added to the cladding material, but occurs as an impurity in the other components. It is known that calcium levels, even as low as 0.005%, can interfere with formation of a proper braze joint in a vacuum brazing process. When the calcium levels are too high the cladding material does not "wet" and flow into the joint region leading to lack of joint formation or incomplete joints. Prior to discovery of the present invention numerous steps were taken to remove calcium from the cladding material to prevent its undesirable effect on braze joint formation.

SUMMARY OF THE INVENTION

In one embodiment, the present invention is a method for forming a vacuum brazing cladding material comprising the steps of: providing a base material of aluminum, an aluminum alloy, or mixtures thereof; combining the base material with magnesium to form a cladding material; and adjusting the ratio of magnesium to calcium in the cladding material to a level of at least 625 to 1.

In another embodiment, the present invention is a method for vacuum brazing aluminum stock materials comprising the steps of: providing two pieces of stock material to be joined, each comprising aluminum, an aluminum alloy, or a mixture thereof; providing a cladding material comprising a base material of aluminum, an aluminum alloy, or mixtures thereof and magnesium, wherein the ratio of magnesium to calcium in the cladding material is at least 625 to 1; cladding at least a portion of at least one of the pieces of stock material with the cladding material; and placing the two pieces of stock material adjacent to each other with the cladding material sandwiched between them and vacuum brazing the two pieces of stock material.

In another embodiment, the present invention is a vacuum brazing cladding material comprising a base material of aluminum, aluminum alloy, or mixtures thereof, a melting point lowering agent, and magnesium, the cladding material having a ratio of magnesium to calcium of at least 625 to 1.

DESCRIPTION OF THE PREFERRED EMBODIMENT

The present invention is a method for joining aluminum or aluminum alloy stock pieces to each other using a vacuum brazing process wherein the ratio of magnesium to calcium ratio is carefully controlled. The stock materials encompassed by the present invention may comprise either pure aluminum or aluminum alloys, as are known to those of ordinary skill in the art. Thus, in the present specification and claims the terms "stock material" and "aluminum stock material" are used interchangeably to refer to any pure aluminum or aluminum alloy stock material. The aluminum stock material can be of any shape or form and can be a component of any item, for illustrative purposes in the present invention the aluminum stock material that will be described is that typically used in the formation of heat exchangers. It should be understood by those of ordinary skill in the art, however, that the present invention is applicable to joining of any aluminum or aluminum alloy stock materials to each other utilizing a vacuum brazing process.

Figure 1:
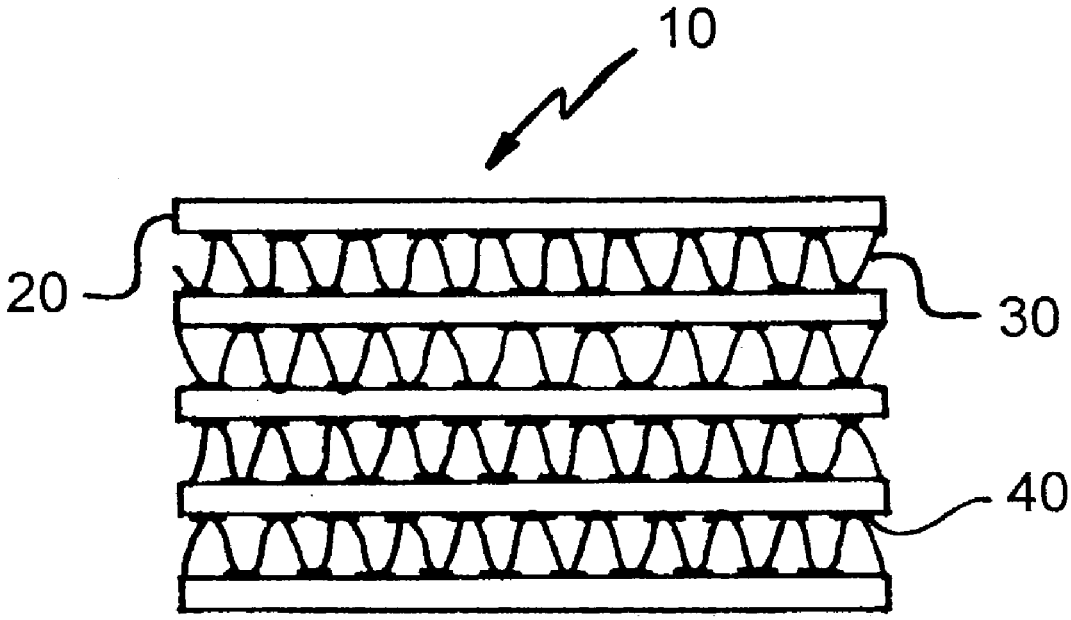
FIG. 1 is a schematic diagram of a cross-sectioned view of a portion of a heat exchanger with braze joints according to the present invention.

In FIG. 1 a schematic diagram of a cross-sectional view of a portion of heat exchanger is shown generally at 10. A series of flat tubes 20 are arranged in parallel rows with a convoluted fin stock 30 between adjacent tubes 20. It is typical to apply a cladding material to the outside of each tube 20 rather than to the convoluted fin stock 30. Of course the cladding material could also be applied to the fin stock 30. The cladding material is generally rolled onto the tube 20 as a thin layer forming a multi-layer composite structure. When forming bonds between aluminum tubes 20 and convoluted fin stock 30 for utilization in heat exchangers it is preferable that the thickness of the cladding material range from 5 to 15% of the thickness of the tube 20, more preferably from 9 to 14%, and most preferably from 10 to 12%. It is possible when joining other aluminum stock material pieces to each other to use cladding material thickness levels that are outside of these ranges. During the brazing process the cladding material flows between the fin stock 30 and the tubes 20 to form a braze joint 40 thus joining the tubes 20 and fin stock 30 into a unitary structure.

As discussed above, the cladding material typically comprises principally aluminum with additional components added to lower the melting temperature below that of the melting temperature of the aluminum stock materials. Other components are added to the cladding material to provide other properties such as flowability and wetting ability. As discussed above, silicon is commonly included in the cladding material to lower its melting point. Preferably, the amount of silicon ranges from 5 to 15% by weight of the cladding material, more preferably from 9 to 12% by weight, and most preferably from 9.5 to 10.5% by weight. As discussed above, magnesium is typically added to the cladding material to enhance the wetting action of the cladding material during the brazing process. It is preferable that the amount of magnesium range from 0.15 to 0.5% by weight, more preferably from 0.25 to 0.40% by weight, and most preferably from 0.25 to 0.35% by weight.

One problem that typically occurs with cladding materials utilized for joining aluminum stock materials to each other with a vacuum brazing process is the presence of calcium as an impurity in the components utilized to form the cladding material. The calcium interferes with the ability of the magnesium to provide wetting of the cladding material into the joints leading to failure in brazed joints and improper joint formation. This can result in a vacuum brazing process wherein less than 90% of the possible bonds between the two stock materials form during the brazing process. Prior to the present invention it was believed that the solution to this problem was removal of the calcium to the extent possible from the cladding material.

It has been found in the present invention that it is not necessary to remove calcium from the cladding material, provided the ratio of magnesium to calcium is adjusted to at least a threshold level. Specifically, it has been found that if the ratio of magnesium to calcium in the cladding material is adjusted to at least 625 to 1 or greater, then the adverse affects of calcium on brazed joint formation are dramatically reduced.

Figure 2:
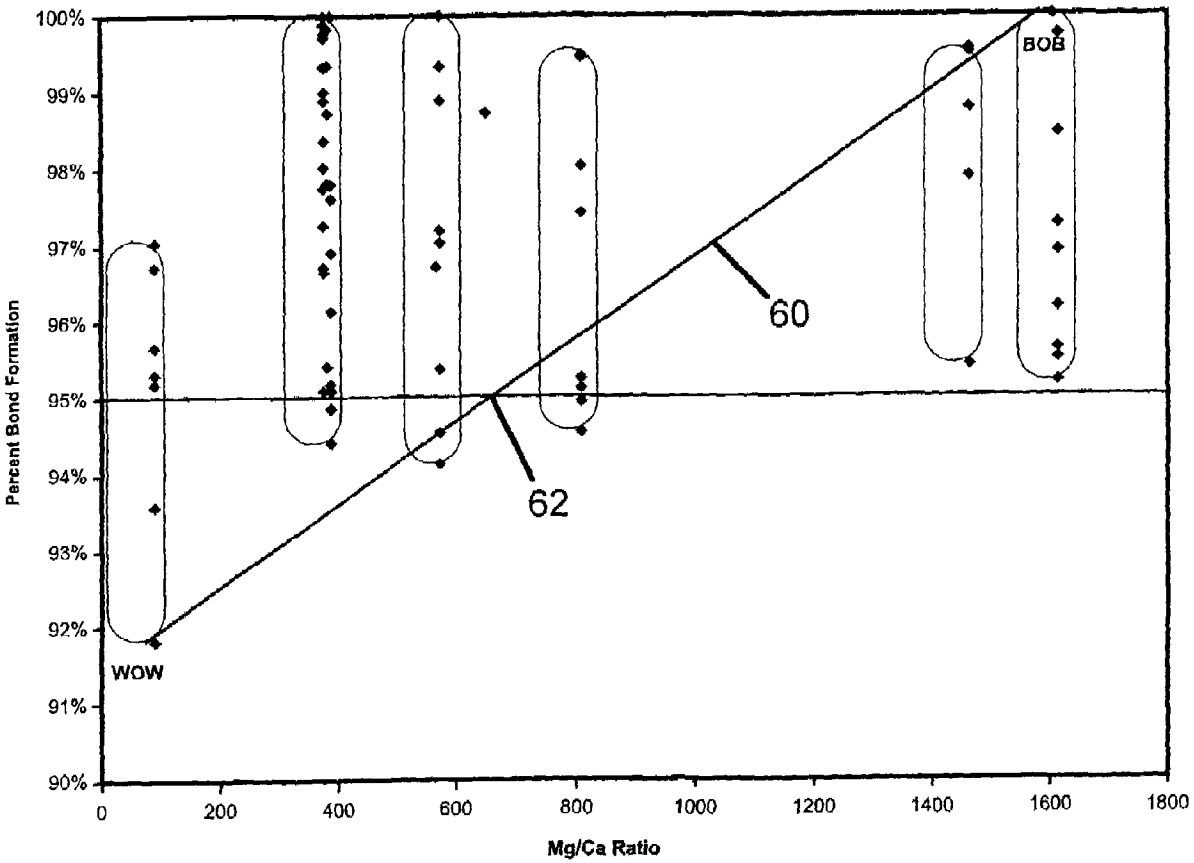
FIG. 2 is a graph of the ratio of magnesium to calcium in a cladding material versus the percent bond formation between two aluminum stock pieces according to the present invention.

The affect of the ratio of magnesium to calcium on brazed joint formation is shown in FIG. 2. To generate the data shown in FIG. 2 a series of tubes 20 were clad with a cladding material comprising aluminum, silicon and one of the six indicated ratios of magnesium to calcium. A piece of convoluted fin stock 30 was placed between every other tube 20 to form a structure like that shown in FIG. 1 at 10. The samples were placed into a vacuum brazing holding fixture, as is known in the art, and then vacuum brazed. Briefly, the vacuum brazing was typical and involved a pre-heating step, a series of brazing heating steps, and then a cool down step. The vacuum chamber was kept at a vacuum level of $5\times10^{-4}$ microns or less. The brazing heating steps were as follows: an initial entrance temperature of 1040° F.; ramp at 40°/minute to 1085° F.; soak at 1085° F. for 8 minutes; ramp at 40°/minute to 1093° F.; and then soak at 1093° F. for 5.3 minutes. The samples were then analyzed by counting the number of complete braze joints 40 in a sample and then dividing by the total number of possible braze joints and multiplying the result by 100 to get the percent bond formation. The data were then analyzed using a six sigma Shainin test to find the red X. The line generated by this analysis is shown at 60 in FIG. 2. The figure also shows the worst of the worst (WOW) and best of the best (BOB). It can be seen from FIG. 2 that when the ratio of magnesium to calcium is about 625 (see point 62 in FIG. 2) or greater the percent bond formation equals or exceeds 95%. The percent bond formation decreases as the ratio of magnesium to calcium falls below 625. The BOB of the samples was found when the magnesium to calcium ratio was about 1600 to 1.

In utilizing the present invention the typical procedure is to form the cladding material comprising aluminum, a melting point reducer such as silicon, and magnesium at the desired levels. Then a sample of the cladding material is analyzed for the level of magnesium and calcium in the cladding material. Based on the results of the analysis the level of magnesium is adjusted as necessary to ensure that the ratio of magnesium to calcium is equal to or greater than 625 to 1. As seen in FIG. 2 ratios as high as 1600 or more can be used to ensure virtually complete joint formation.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A method for forming a vacuum brazing cladding material comprising the steps of: a) providing a base material of aluminum, an aluminum alloy, or mixtures thereof; b) combining the base material with from 0.15 to 0.50% by weight magnesium and from 5 to 15% by weight silicon based on the total weight of the cladding material to form a cladding material; and c) adjusting the ratio of magnesium to calcium in the cladding material to a level of at least 625 to 1.

2. The method of claim 1 comprising providing the silicon at level of from 9 to 12% by weight based on the total weight of the cladding material.

3. The method of claim 1 comprising providing the silicon at level of from 9.5 to 10.5% by weight based on the total weight of the cladding material.

4. The method of claim 1 wherein step b) comprises combining the base material with an amount of from 0.25 to 0.40% by weight magnesium based on the total weight of the cladding material to form the cladding material.

5. The method of claim 1 wherein step b) comprises combining the base material with an amount of from 0.25 to 0.35% by weight magnesium based on the total weight of the cladding material to form the cladding material.

6. The method of claim 1 wherein step c) comprises adjusting the ratio of magnesium to calcium to from 625 to 1 to 1600 to 1.

7. A method for vacuum brazing aluminum stock materials comprising the steps of: a) providing two pieces of stock material to be joined, each comprising aluminum, an aluminum alloy, or a mixture thereof; b) providing a cladding material comprising a base material of aluminum, an aluminum alloy, or mixtures thereof in combination with from 5 to 15% by weight silicon and 0.15 to 0.5% by weight magnesium based on the total weight of the cladding material, wherein the ratio of magnesium to calcium in the cladding material is at least 625 to 1; c) cladding at least a portion of at least one of the pieces of stock material with the cladding material; and d) placing the two pieces of stock material adjacent to each other with the cladding material sandwiched between them and vacuum brazing the two pieces of stock material.

8. The method of claim 7 wherein in step a) comprises providing a tube as one of the pieces of stock material and a convoluted fin stock as the other of the two pieces of stock material.

9. The method of claim 7 comprising providing the silicon at level of from 5 to 15% by weight based on the total weight of the cladding material.

10. The method of claim 7 comprising providing the silicon at level of from 9 to 12% by weight based on the total weight of the cladding material.

11. The method of claim 7 comprising providing the silicon at level of from 9.5 to 10.5% by weight based on the total weight of the cladding material.

12. The method of claim 7 wherein step b) comprises combining the base material with an amount of from 0.25 to 0.40% by weight magnesium based on the total weight of the cladding material to form the cladding material.

13. The method of claim 7 wherein step b) comprises combining the base material with an amount of from 0.25 to 0.35% by weight magnesium based on the total weight of the cladding material to form the cladding material.

14. The method of claim 7 wherein step b) further comprises adjusting the ratio of magnesium to calcium in the cladding material to from 625 to 1 to 1600 to 1.

15. A vacuum brazing cladding material comprising a base material of aluminum, aluminum alloy, or mixtures thereof, a melting point lowering agent comprising from 5 to 15% by weight silicon based on the total weight, and from 0.15 to 0.5% by weight magnesium based on total weight, said cladding material having a ratio of magnesium to calcium of at least 625 to 1.

16. The vacuum brazing cladding material of claim 15 wherein the silicon level is from 9 to 12% by weight based on the total weight of the cladding material.

17. The vacuum brazing cladding material of claim 15 wherein the silicon level is from 9.5 to 10.5% by weight based on the total weight of the cladding material.

18. The vacuum brazing cladding material of claim 15 having an amount of from 0.25 to 0.40% by weight magnesium based on the total weight of the cladding material.

19. The vacuum brazing cladding material of claim 15 having an amount of from 0.25 to 0.35% by weight magnesium based on the total weight of the cladding material.

20. The vacuum brazing cladding material of claim 15 wherein the ratio of magnesium to calcium in the cladding material is from 625 to 1 to 1600 to 1.

* * * * *